US007467058B2

(12) United States Patent
Boyd

(10) Patent No.: US 7,467,058 B2
(45) Date of Patent: Dec. 16, 2008

(54) METHOD AND SYSTEM FOR SELECTING A MATTRESS

(75) Inventor: Dennis M. Boyd, 2440 Adie Rd., Maryland Heights, MO (US) 63043

(73) Assignee: Dennis M. Boyd, Maryland Heights, MO (US)

( * ) Notice: Subject to any disclaimer, the term of this patent is extended or adjusted under 35 U.S.C. 154(b) by 142 days.

(21) Appl. No.: 11/399,059

(22) Filed: Apr. 6, 2006

(65) Prior Publication Data

US 2007/0238935 A1 Oct. 11, 2007

(51) Int. Cl.
*G01D 1/00* (2006.01)

(52) U.S. Cl. ..... 702/127

(58) Field of Classification Search ..... 702/127, 702/129, 139, 189

See application file for complete search history.

(56) References Cited

U.S. PATENT DOCUMENTS 5,148,706 A * 9/1992 Masuda et al. ..... 73/172
6,571,192 B1 5/2003 Hinshaw et al.
6,741,950 B2 5/2004 Hinshaw et al.
6,990,425 B2 1/2006 Hinshaw et al.
2002/0013743 A1 1/2002 Shoffner
2004/0194270 A1 10/2004 Flippin

OTHER PUBLICATIONS

Seth Stevenson, "Going to the Mstresses", Slate, Nov. 23, 2000.*

* cited by examiner

*Primary Examiner*—Bryan Bui
*Assistant Examiner*—Stephen J Cherry
(74) *Attorney, Agent, or Firm*—Thompson Coburn LLP

(57) ABSTRACT

A method and system is provided for diagnosing a subject's desired level of support and comfort. In accordance with the method, a diagnostic mattress with an adjustable support structure is provided. A subject is positioned on the diagnostic mattress. The adjustable support structure of the diagnostic mattress is adjusted in accordance with a desired level of support as determined by the subject positioned on the diagnostic mattress. The subject's desired support level is correlated to a support characteristic of a mattress with a fixed support structure thereby allowing the subject to select a mattress with a fixed support structure characteristic generally equal to the subject's desired support level as determined from the diagnostic mattress. System employing the method is also disclosed.

19 Claims, 4 Drawing Sheets

METHOD AND SYSTEM FOR SELECTING A MATTRESS

FIELD OF THE INVENTION

This application relates to a method and system for selecting a mattress.

BACKGROUND OF THE INVENTION

Most everyone desires a good night's rest. Choosing the right mattress is essential to ensuring a restful sleep. However, choosing the correct mattress is one of the most confusing decisions a consumer has to make. There is very little technical information about the mattresses provided by the retailer or manufacturer so making a comparison of different mattresses is difficult.

Additionally, consumers generally have a challenging time verbalizing to the retail salesperson what they want in a mattress. This inability to verbalize the characteristics of a mattress creates a disconnect between a consumer and a salesperson in the typical retail environment. Often in the retail environment when a consumer walks into a store and asks to see a mattress, the salesperson likely posits the question, "What kind of a mattress are you looking for?" The customer usually then replies, "Firm," "Supportive," "Pillowtop," or "The one that's on sale." This exchange is unproductive. None of the consumer's answers help the salesperson understand how to match a mattress with the consumer's specific needs. Many times a consumer will think they want a "firm mattress." However, after sampling several "firm mattresses" offered by the salesperson and objecting to them because they "feel too hard," consumers eventually come to the realization that what they really need is a medium or plush mattress. Unfortunately, this process of repeatedly sampling mattresses offered by the salesperson tends to frustrate the consumer. More often than not, frustrated with the sales experience, the consumer will leave the store and the purchase of a mattress to another day—less often will the consumer doggedly persist through the sampling process to finally arrive at a mattress that fits his or her needs.

Ultimately, the consumer is looking for a better night's sleep and wants to purchase a quality mattress to improve their chances of achieving this. Further complicating the mattress selection process is the fact that there are two main variables affecting a consumer's purchasing decision, comfort and support. In order to find a quality mattress that meets the consumer's needs, it must have the right combination of both comfort and support. However, whether a quality mattress has the right combination of comfort and support for particular consumer is a very subjective individualized assessment. Currently, this assessment is made through the verbal exchange of the salesperson and consumer, as explained above. And as explained above, defining comfort or support verbally is not an easy task, and one which can easily frustrate the sales process and result in the consumer either leaving the store or choosing a mattress that is not a good fit for him or her. In the latter case, the store must then deal with returns, unhappy customers and/or lost profits.

Compounding the problem is that most consumers test a prospective new mattress while lying on their backs. Most consumers and salespersons ignore that approximately 65% of consumers actually sleep on their side. A mattress that feels good when one is lying on his or her back does not necessarily feel good when one is lying on his or her side. When lying on one's side, one will generate additional surface pressure as his or her weight is dispersed over a smaller area. In addition, when lying on one's side, the profile of the body is more generally pronounced. In other words, in the side lying position, the vertical height difference between the shoulder and the waist is generally greater than the vertical height difference between the lumbar and buttocks in the back lying (supine) position. This difference in weight distribution results in different pressure points for a side sleeper and a back sleeper. Thus, depending upon whether the consumer is predominantly a side sleeper or a back sleeper, the support structure of the mattress may need to be substantially different. Because of differences in a consumer's body profile and pressure points in the predominant sleep position, it is important for a consumer to define comfort and support in terms of his or her predominant sleep position.

What is needed is a better way to quickly and effectively select a mattress that will best match the consumer's definition of comfort and support.

SUMMARY OF THE INVENTION

The present invention comprises a method and system to determine a consumer's need for support and comfort in a mattress. The method and system of the present invention assists a consumer in rendering an otherwise subjective definition of comfort and support to an objective measurement that assists the consumer in selecting a mattress. Armed with an objective measurement of comfort and support, a consumer may more effectively and quickly select a mattress according to his or her needs for support, taking into account his or hers specific body profile, height, weight, weight distribution and sleep position. Thus, the present invention overcomes the drawbacks heretofore seen in the retail environment and provides a method for the salesperson or consumer to quickly and effectively match a mattress to the consumer based upon the consumer's definition of comfort and support.

In one aspect of the present invention a method is provided. In accordance with the method, a diagnostic mattress with an adjustable support structure is provided. A subject is positioned on the diagnostic mattress. The adjustable support structure of the diagnostic mattress is adjusted in accordance with a desired level of support as determined by the subject positioned on the diagnostic mattress. The subject's desired support level is correlated to a support characteristic of a mattress with a fixed support structure thereby allowing the subject to select a fixed support structure mattress with a structure characteristic generally equal to the subject's desired support level as determined from the diagnostic mattress.

In another aspect of the present invention, a method is provided. In accordance with the method, a plurality of mattresses is provided with each mattress in the plurality having a fixed support structure and a corresponding support characteristic. A diagnostic mattress is provided with an adjustable support structure. The adjustable support structure of the diagnostic mattress is adjusted to a specified support level that generally approximates the support characteristic of the fixed support structure of each mattress in the plurality. An index is generated representative of the specified support level and the index is correlated to each mattress in the plurality based upon the support characteristic of the fixed support structure.

In another aspect of the present invention a system is provided. The system comprises a plurality of mattresses with fixed support structures with each mattress in the plurality having a support characteristic representative of the fixed support structure. The system further comprises a diagnostic mattress with an adjustable support structure having a controller for selectively adjusting the adjustable support structure in accordance with a desired level of support as determined by a subject positioned on the diagnostic mattress. The diagnostic mattress controller is adapted to generate a report correlating the subject's desired support level to the support characteristic of a mattress in the plurality of mattresses thereby allowing the subject to select a mattress with a fixed support structure support characteristic generally equal to the subject's desired support level as determined from the diagnostic mattress based upon the report.

Further objects and features of the invention are revealed in the following detailed description of the preferred embodiment of the invention and in the drawings which follow.

BRIEF DESCRIPTION OF THE DRAWINGS

Corresponding reference numbers indicate corresponding parts throughout the several views of the drawings.

DETAILED DESCRIPTION OF THE PREFERRED EMBODIMENT

The inventor has conducted, reviewed and analyzed extensive research and studies to assist in determining the level of support associated with fixed support structures for mattresses, such as conventional inner spring mattresses and foundations. A portion of the research has included correlating the support level associated with the fixed support structures of conventional inner spring mattresses and foundations to the support level achieved with a mattress having an adjustable support structure, such as an air mattress. The inventor has successfully developed a method and system to use the indication on a control of the adjustable support structure to assist in the selection of a mattress with a fixed support structure support characteristic that closely approximates the indicated support level of the air mattress.

Figure 1:
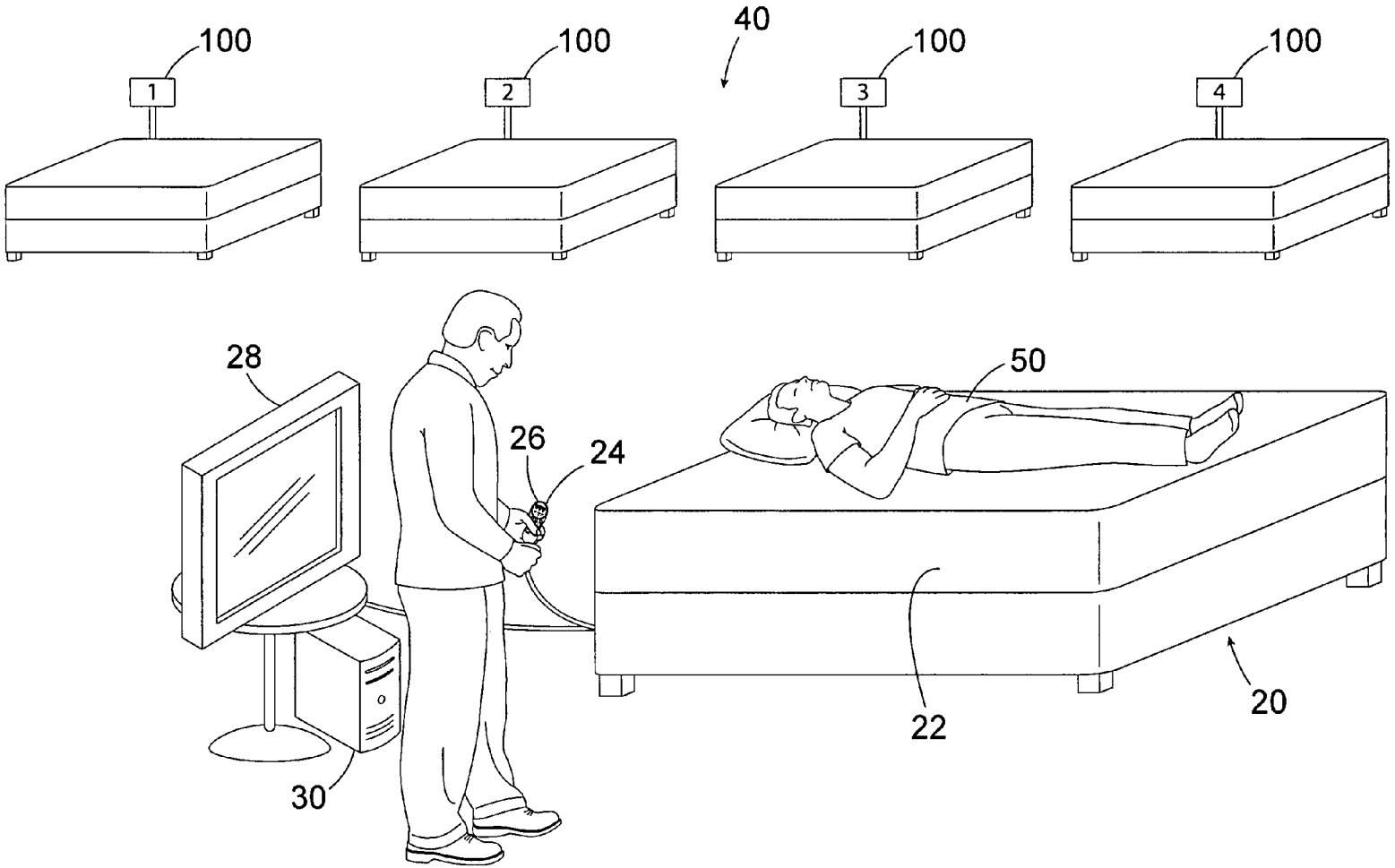
FIG. 1 shows implementation of a mattress selection system in accordance with one embodiment of the present invention employed in a retail store environment, including a diagnostic mattress with an adjustable support structure and a control therefor, and a plurality of mattresses with fixed support structures.

FIG. 1 provides a general overview of the system of the present invention employed in a retail environment. A diagnostic mattress with an adjustable support structure is shown generally indicated by reference character 20. Connected to the adjustable support structure 22 is a controller 24 for selectively adjusting a level of support in the support structure. An indicator 26 is provided on the controller 24 to indicate the support level of the adjustable support structure. A large screen display 28 and computer 30 may also be provided as a controller for adjusting the adjustable support structure 22. Preferably, in a different area of the retail establishment, a plurality of mattresses 40 with varying fixed support structures are provided. Each of the mattresses 40 has been previously surveyed in accordance with the principles of the invention and a support characteristic of the fixed support structure of each mattress has been determined and assigned to each mattress in the plurality.

Figure 2:
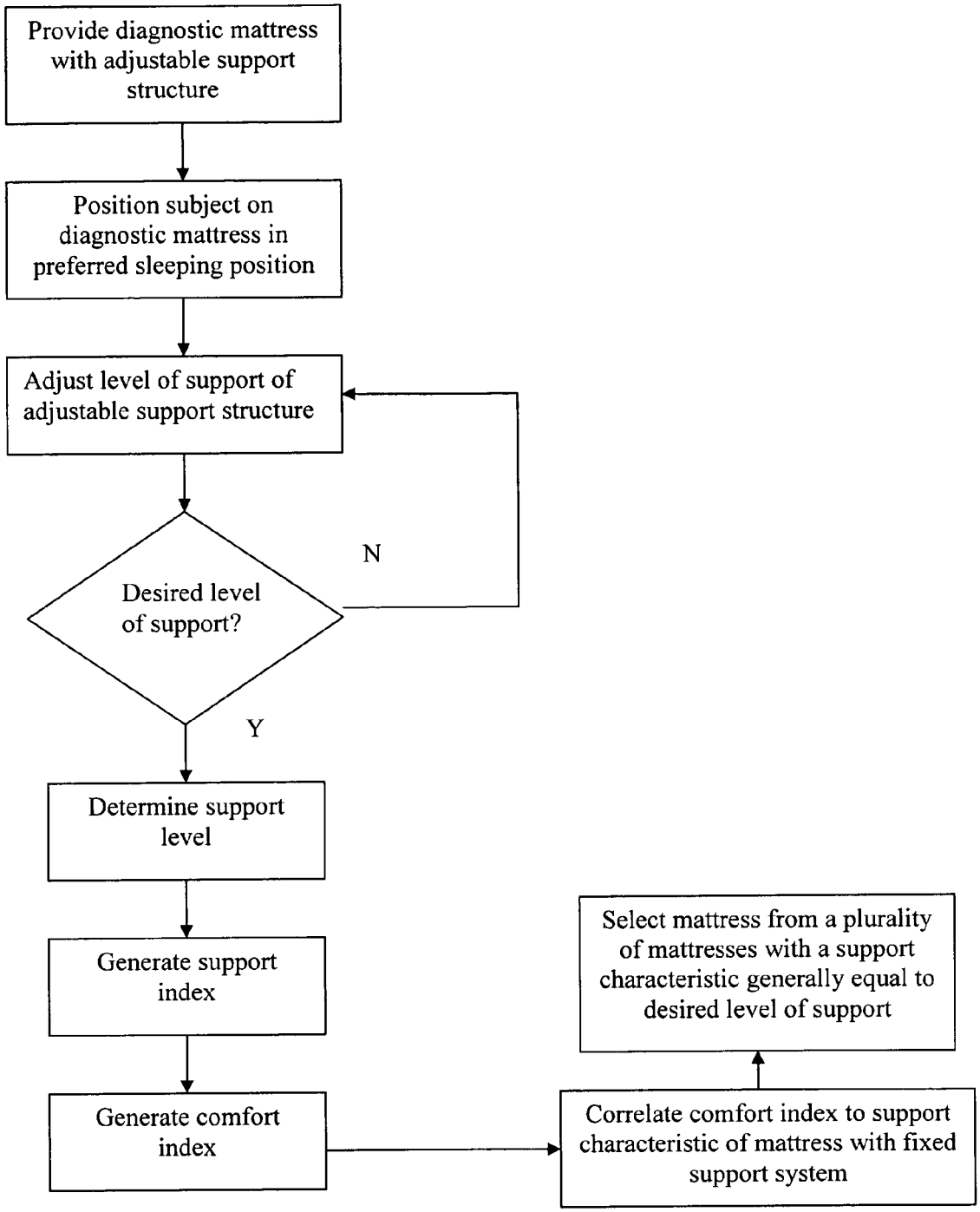
FIG. 2 shows a flow chart comprising an aspect of the method of the present invention where a consumer's desired level of support is correlated to a support characteristic of a mattress with a fixed support structure.

Referring to FIGS. 1 and 2, in operation, a consumer 50 is positioned on the diagnostic mattress 20 and the adjustable support structure 22 is adjusted using the controller 24 in accordance with a desired level of support of the consumer. Preferably, the consumer 50 is directed to lie on the diagnostic mattress 20 in his or her predominant sleep position. Thus, while the consumer shown in FIG. 1 is lying on his or her back, it should be appreciated that the consumer could be on his or her side or stomach, if either of these were the preferred sleeping position. The level of support of the adjustable support structure is varied with the controller 24 as desired by the consumer until the consumer is satisfied with the level of support and comfort. The level of support of the adjustable support structure as selected by the consumer is then correlated to one or more mattresses 40 having a fixed support structure support characteristic that most closely approximates the level of support of the adjustable support structure. In this way, the consumer may render an otherwise subjective criteria of support and comfort to an objective measurement, which in turn helps the consumer and salesperson efficiently select a mattress with a fixed support structure that closely matches the consumer's needs. With this general overview, more detailed aspects of the invention follow below.

Diagnostic Mattress and Controller

As described previously, the diagnostic mattress 20 includes a controller 24 for adjusting the level of support of the adjustable support structure 22. Preferably, the controller 24 is a hand held controller with the indicator 26 indicating the relative level of support of the adjustable support structure. Depending upon the type of adjustable support structure, the controller will vary. For instance, when the adjustable support structure is configured as a single chamber air mattress, the controller will be similar to a controller 60 shown in FIG. 3 and include an indicator 62 and controls 64 to adjust the amount of air pressure in the air mattress. Preferably, the indicator has a scale 66 indicating a relative amount of air pressure in the air mattress and a corresponding numeric representation 68 of the scale. In the embodiment shown in FIGS. 3 and 4, the numeric representation 68 extends from 1 to 100 where 1 is an extremely low level of air pressure in the air mattress and 100 is the maximum amount of air pressure in the mattress. However, the numeric representation may be any range of numbers.

Figure 4:
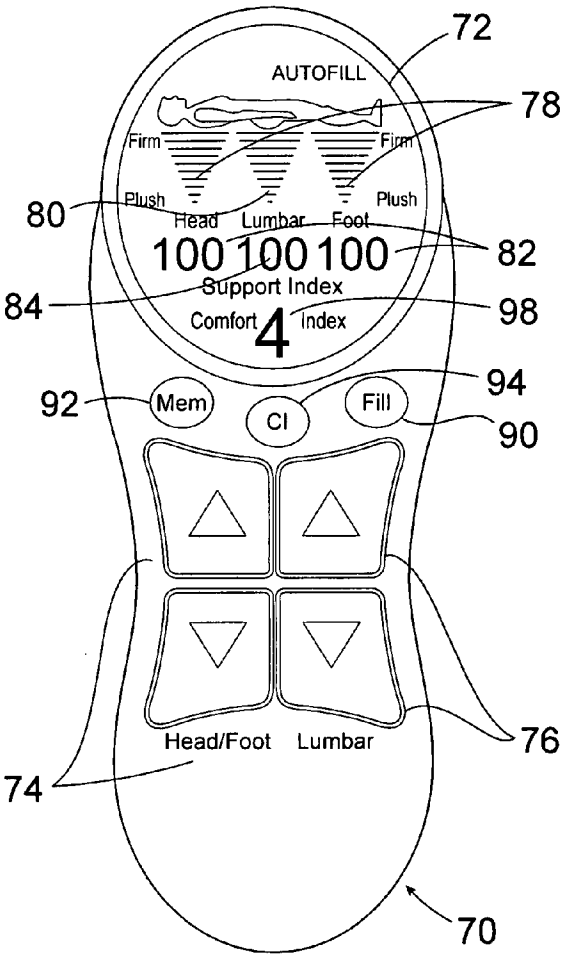
FIG. 4 shows an alternative embodiment of an indicator of a controller of a multi-chamber diagnostic mattress similar to that shown in FIG. 1 displaying information related to a subject's desired level of support for each chamber and an index correlating the subject's desired level of support to a support characteristic of a fixed support structure of a mattress in the plurality of mattresses.

FIG. 4 shows a controller 70 of another embodiment of the present invention where the adjustable support structure comprises a three-chamber air mattress. In the three chamber air mattress contemplated by the inventor, the chambers that are aligned to the user's feet and head are in fluid communication and separated from the chamber aligned to the user's lumber region. The controller 70 includes an indicator 72 and controls for separately selecting the level of support for both the foot and head region 74, and the lumbar region 76. The controller indicator 72 displays three scales: one for each of the foot and head region 78, and one for the lumbar region 80 of the air mattress. The controller indicator also displays a numeric representation of each scale, i.e., one for each of the foot and head region 82, and one for the lumbar region 84 of the air mattress. In the embodiment shown in FIG. 4, the numeric representations 82,84 extend from 1 to 100 for each chamber where 1 is an extremely low level of air pressure in the respective chamber and 100 is the maximum amount of air pressure in the respective chamber. Again, its should be appreciated that the numeric representations may be any range of numbers.

Figure 3:
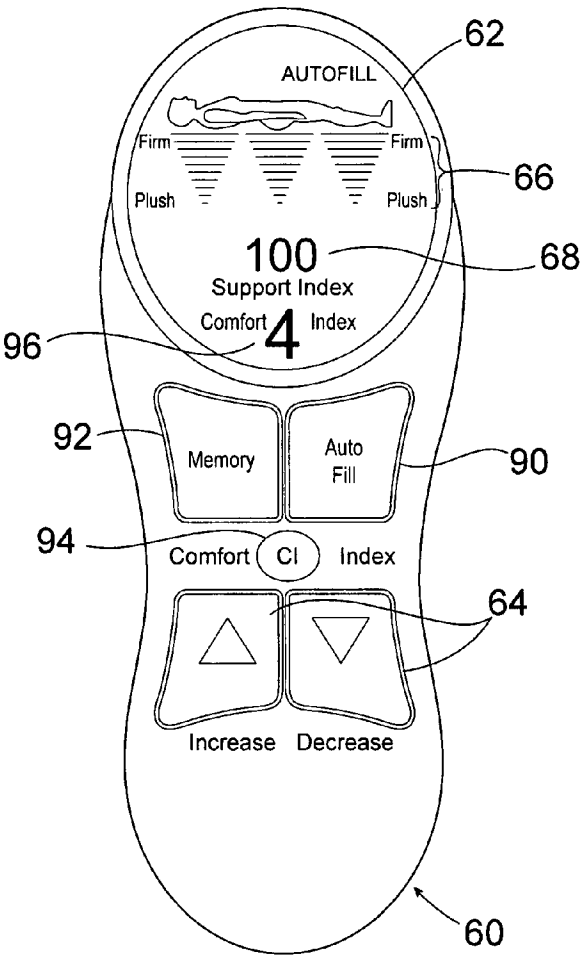
FIG. 3 shows one embodiment of an indicator of a controller of a single chamber diagnostic mattress similar to that shown in FIG. 1 displaying information related to a subject's desired level of support and an index correlating the subject's desired level of support to a support characteristic of a fixed support structure of a mattress in the plurality of mattresses.

Each of the controllers shown in FIGS. 3 and 4 may also include a control 90 for automatically adjusting the mattress to the maximum level of support, a memory button 92 for remembering a level of support and another button for displaying a comfort index 94 as will be discussed in greater detail below.

Support Index

As stated above, a consumer's desired level of support is established by adjusting the adjustable support structure 22 in accordance with the consumer's direction. A support index may be generated to correspond to the level of support of the adjustable support structure. In a preferred embodiment, the support index corresponds to the numeric representation (FIG. 2, 68; FIG. 3, 82,84) of the support level as indicated on the indicator of the controller of the adjustable support structure. Thus, the support level may comprise a scale of 1 to 100 as indicated on the indicator of the controller. Preferably, the support index is displayed continuously and in real time on the indicator. In the case of an adjustable support structure having multiple chambers, the support index may also comprise a composite of the support levels indicated on the controller. For instance, where the diagnostic mattress comprises a three chamber air mattress, the level indicated for the lumbar region may be afforded more or less weight in determining the support index depending upon the consumer's physical attributes. In other words, for a consumer with a heavier build, the lumbar region indicated level may be afforded more weight in determining the support index.

Comfort Index

Figure 5:
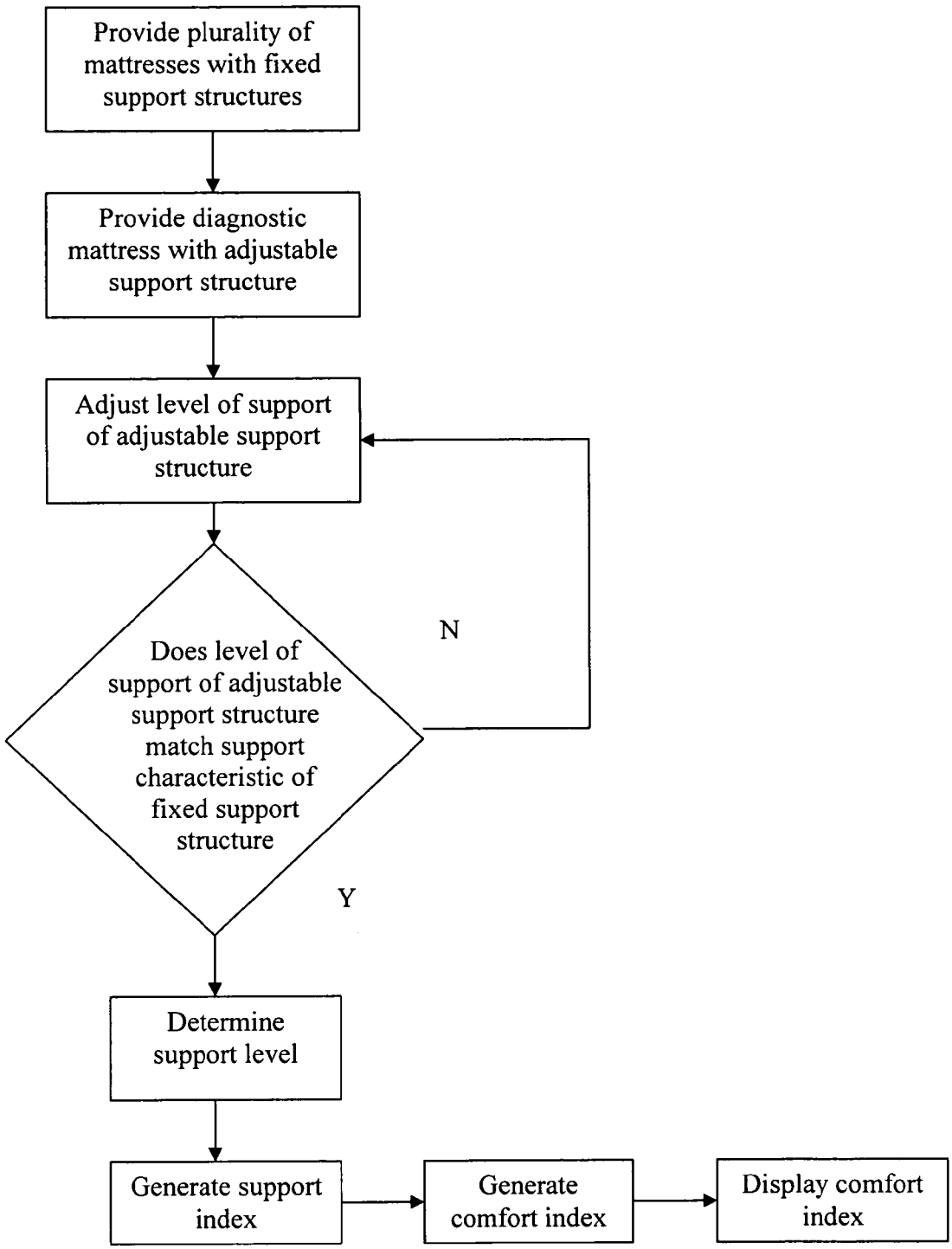
FIG. 5 shows a flow chart comprising an aspect of the method of the present invention where a support characteristic of a mattress with a fixed support structure is determined.

The support characteristic of the fixed support structure of the mattress corresponds to an equivalent level of support as adjusted on the adjustable support structure of the diagnosis mattress. FIG. 5 shows the process for developing a support characteristic of a mattress with a fixed support structure. Empirical measurements may be used to correlate the support characteristic of the fixed support structure with the level of support of the adjustable support system, i.e., load deflection analysis. Experienced personnel may also personally test mattresses with fixed support structures vis-à-vis the diagnostic mattress of the adjustable support structure, and assign to the fixed support structure the support characteristic equivalent of the level of support as determined from the adjustable support system. Preferably, experienced personnel adjust the adjustable support structure until it matches the level of support sensed when lying on a mattress with a fixed support structure. After the adjustable support structure is adjusted such that its level of support matches the level of support of the fixed support structure, the indicated level of support or support index of the adjustable support structure may be assigned to the fixed support structure as the support characteristic.

In a preferred embodiment of the invention, the support characteristic of a plurality mattresses having fixed support structures are further categorized by a comfort index. The comfort index may correspond directly to a level of support of the adjustable support structure. The comfort index may also correspond to a range of support levels or support indices as indicated on the controller indicator. In a preferred embodiment, the comfort index may be correlated to a support index ranging between 1 and 100 by using the following chart:

| Comfort Index | Designation | Support Index |
|---|---|---|
| 1 | Plush | 1-20 |
| 2 | Medium-Plush | 21-45 |
| 3 | Medium-Firm | 46-65 |
| 4 | Firm | 66-100 |

In the above chart, one comfort index corresponds to a range of indicated support indices, and thus, one comfort index may encompass a range of support characteristics of fixed support structure mattress systems. Other or additional designation categories may be used, for instance, soft, plush, medium-plush, medium-firm, firm, and super-firm, and the support indices would be further defined to match these categories.

The comfort index may be displayed on the controller indicator (FIG. 2, 96; FIG. 3, 98). Preferably, the comfort index is illuminated when the comfort index button 94 is depressed on the controller. The memory button 92 on the controller may be used to remember or set a comfort index and/or support index, and automatically adjust the adjustable support structure to the set or "remembered" level of support.

The comfort index 100 may then be displayed in a prominent fashion adjacent to or on the respective fixed support structure, for instance, using a placard or banner or by affixing a tag to the mattress (FIG. 1).

Computer And Display

As stated previously, the method and system of the present invention may also include a large screen display 28 and computer 30 (FIG. 1). In a preferred embodiment, a large screen display 28 may be provided to display the relative level of support of the adjustable support structure. A computer may be provided to sense the level of support of the adjustable support structure independently of the controller, or the controller may be connected to the computer. The computer may be configured to allow an operator to use the computer to adjust the adjustable support system. The computer may be configured to create a display on the large screen display similar to that found on the indicator. The large screen display may be used to assist in making the sales presentation. Other point of sale information may be positioned about the large screen display. For instance, a kiosk (not shown) may provide a convenient station to house the large screen display, computer and point of sale information. The computer may have software for storing information relating to the consumer. For instance, the computer may have software for generating a personalized report of the consumer's information including his or her level of support as will be discussed below. The large screen display may be a touch screen graphic user interface thereby eliminating the need for a keyboard. The large screen display may be used in place of the controller or in addition to a separate controller. The computer may interface with the retail establishment's inventory control system to provide a consumer with a list of mattresses in stock corresponding to the consumer's selected and desired support level. A computer interfaced on a network, such as the internet, also allows the diagnosis steps discussed below to be performed at a remote location.

Operation

FIGS. 2 and 5 shows the sequential steps of the preferred method of the invention. In operation, the salesperson asks the consumer to identify the position in which the consumer customarily falls asleep, i.e., side, back, or stomach. The customer then lies on the diagnostic mattress 20 in that position and the salesperson adjusts the level of support of the adjustable support structure 22 of the diagnostic mattress using the controller 24 in accordance with the direction of the consumer to arrive at the perfect setting of comfort and support as defined by the consumer. Once the consumer confirms to the salesperson that the level of support of the diagnostic mattress feels "right" or that the diagnostic mattress feels "good there," the salesperson presses the "Comfort Index" button 94 on the controller and the comfort index illuminates. Armed with the comfort index, the consumer and salesperson have narrowed the search for a perfect mattress. Preferably, mattresses having support levels corresponding to the comfort index are on display in the retail establishment, and the consumer can chose a fixed support structure for a mattress based upon the comfort index.

It is not necessary to have the plurality of mattresses in the same location as the diagnostic mattress. The assessment using the diagnostic mattress may be made a remote location different than that of the actual purchase.

Further, a consumer and his or her sleeping companion can each be diagnosed in the matter set forth above, and if there is a great disparity of comfort indices between the two, a mattress system may be constructed having a fixed support structure on one side that matches the one consumer and a fixed support structure on the other side that matches the other consumer.

The diagnostic mattress may also include a pressure mapping system having sensors to determine points of pressure as the consumer lies on the diagnostic mattress in his or her predominant sleep position. The computer shown in FIG. 1 may be configured with software to operate the pressure mapping program and display results on the larger screen display. The results of the pressure mapping system may be used to determine if the consumer's desired level of support properly alleviates pressure points. For instance, it has been determined that if a sleeping person experiences pressure in excess of 32 ml of water, the person will awake from the sleep sufficiently to reposition themselves. To provide a sound night's rest, a consumer may wish to reduce pressure and the corresponding frequency of tossing and turning. A pressure mapping system used in conjunction with the diagnostic method employed herein provides a cross check to ensure the consumer's desired level of support does not create pressure points that exceed 32 ml of water. A pressure mapping system may also be used as a starting point for adjusting the adjustable support structure and naturally arriving at a consumer's desired support level.

Various other changes to the preferred embodiment of this invention described above may be envisioned by those of ordinary skill in the art. However, those changes and modifications should be considered as part of the invention which is limited only by the scope of the claims appended hereto and their legal equivalents.

What is claimed is:

1. A method comprising:

providing a diagnostic mattress with an adjustable support structure;

positioning a subject on the diagnostic mattress;

adjusting the adjustable support structure of the diagnostic mattress in accordance with a desired level of support as determined by the subject positioned on the diagnostic mattress; and correlating the subject's desired support level to a support characteristic of a mattress having a fixed support structure thereby allowing the subject to select a fixed support structure support characteristic generally equal to the subject's desired support level as determined from the diagnostic mattress.

2. The method of claim 1, further comprising providing a plurality of mattresses having fixed support structures from which the subject may select a fixed support structure support characteristic generally equal to the subject's desired support level as determined from the diagnostic mattress.

3. The method of claim 1, further comprising generating an index representative of the subject's desired support level.

4. The method of claim 3, wherein the step of providing a diagnostic mattress further comprises providing an indicator operatively connected to the adjustable support structure adapted to indicate the subject's desired support level; and further comprising indicating the index on the indicator.

5. The method of claim 4, wherein the indicator comprises a controller adapted to adjust the adjustable support structure; and the step of adjusting the adjustable support structure includes operating the controller to adjust the adjustable support structure.

6. The method of claim 4, wherein the index comprises a range of support characteristics of fixed support structures of a plurality of mattresses; and the step of indicating the index on the indicator further comprises indicating the range on the indicator.

7. The method of claim 2, further comprising affixing the support characteristic of the fixed support structure of the mattress to the mattress and displaying the support characteristic of the fixed support structure of the mattress in manner visible to the subject.

8. The method of claim 1, wherein the support characteristic is a designation representative of at least one of soft, plush, medium-plush, medium-firm, firm, and super-firm.

9. The method of claim 1, wherein the diagnostic mattress comprises a multi-chamber air mattress; and the step of adjusting the adjustable support structure of the diagnostic mattress further comprises adjusting a support level of each chamber of the multi-chamber air mattress in accordance with a desired level of support as determined by the subject positioned on the diagnostic mattress.

10. The method of claim 9, further comprising generating an index representative of the subject's desired support level for each chamber of the multi-chamber air mattress.

11. The method of claim 10, further comprising generating a composite index representative of the subject's desired support level for each chamber of the multi-chamber air mattress.

12. The method of claim 1, further comprising:

removing the subject from the diagnostic mattress and positioning a second subject on the diagnostic mattress;

adjusting the adjustable support structure of the diagnostic mattress in accordance with a desired level of support as determined by the second subject positioned on the diagnostic mattress; and correlating the second subject's desired support level to a support characteristic of a mattress with a fixed support structure thereby allowing the second subject to select a fixed support structure support characteristic generally equal to the second subject's desired support level.

13. The method of claim 12 further comprising providing a mattress with a first fixed support structure portion having a support characteristic generally equal to the subject's desired support level and a second fixed support structure portion having a support characteristic generally equal to the second subject's desired support level.

14. The method of claim 1 wherein the step of positioning the subject on the diagnostic mattress includes positioning the subject in accordance with the subject's desired position for sleeping.

15. A system comprising:

a plurality of mattresses with fixed support structures each having a support characteristic representative of the fixed support structure; and a diagnostic mattress with an adjustable support structure having a controller for selectively adjusting the adjustable support structure in accordance with a desired level of support as determined by a subject positioned on the diagnostic mattress, the controller being adapted to generate a report correlating the subject's desired support level to a support characteristic of a fixed support structure of a mattress in the plurality of mattresses thereby allowing the subject to select a mattress with a fixed support structure support characteristic generally equal to the subject's desired support level as determined from the diagnostic mattress based upon the report.

16. The system of claim 15, wherein the fixed support structure characteristic one of soft, plush, medium-plush, medium-firm, firm, and super-firm.

17. The system of claim 15, wherein the report comprises a displayed indication on the controller.

18. The system of claim 15, wherein the controller is adapted to display an index representative of the subject's desired level of support.

19. The system of claim 15, wherein each mattress in the plurality of mattresses has indicia displaying the mattress' fixed support structure support characteristic.

* * * * *